US006475281B1

(12) United States Patent
Bernert

(10) Patent No.: US 6,475,281 B1
(45) **Date of Patent: *Nov. 5, 2002**

(54) APPLICATOR FOR DIRECT OR INDIRECT APPLICATION OF A LIQUID OR PASTY COATING MEDIUM ONTO A TRAVELING MATERIAL WEB

(75) Inventor: Richard Bernert, Giengen (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/547,164

(22) Filed: Apr. 11, 2000

Related U.S. Application Data

(63) Continuation of application No. 08/905,274, filed on Aug. 6, 1997, now Pat. No. 6,053,978.

(30) Foreign Application Priority Data

Aug. 7, 1996 (DE) ..... 296 13 687 U

(51) Int. Cl.[7] ..... B05B 13/02
(52) U.S. Cl. ..... 118/325; 118/410
(58) Field of Search ..... 118/301, 325, 118/406, 410, 413, 419; 425/461, 465, 466, 467

(56) References Cited

U.S. PATENT DOCUMENTS

| | | | | | |
|---|---|---|---|---|---|
| 3,348,526 | A | | 10/1967 | Neubauer | 118/410 |
| 3,870,454 | A | * | 3/1975 | Penrod | 425/466 |
| 3,941,550 | A | * | 3/1976 | Marion | 425/463 |
| 4,057,385 | A | * | 11/1977 | Yazaki et al. | 425/466 |
| 4,354,452 | A | | 10/1982 | Patterson | 118/413 |
| 4,405,661 | A | | 9/1983 | Alheid | 427/356 |
| 5,018,478 | A | | 5/1991 | Meinander | 118/410 |
| 5,389,150 | A | * | 2/1995 | Baum et al. | 118/410 |
| 5,435,847 | A | | 7/1995 | Shibata et al. | 118/410 |
| 5,436,030 | A | | 7/1995 | Damrau | 427/240 |
| 5,505,609 | A | * | 4/1996 | Cloeren et al. | 264/169 |
| 5,700,342 | A | * | 12/1997 | Giannetti | 156/245 |
| 6,053,978 | A | * | 4/2000 | Bernert | 118/325 |

FOREIGN PATENT DOCUMENTS

| | | | |
|---|---|---|---|
| DE | 38 15 764 A1 | 11/1988 | B05C/11/04 |
| DE | 86 10 164.1 | 4/1989 | B05C/11/04 |

* cited by examiner

*Primary Examiner*—Richard Crispino
*Assistant Examiner*—Kevin P. Shortsle
(74) *Attorney, Agent, or Firm*—Taylor & Aust, P.C.

(57) ABSTRACT

An applicator for one of direct and indirect application of a coating medium onto a traveling fiber material web includes at least one dosing device and a coating edge delimiting device. The at least one dosing device includes a pair of lips with each lip having a free end adjacent the fiber material web and extending transverse to a direction of travel of the fiber material web. Further, the lips define a dosing slot therebetween. The dosing slot is an open-jet nozzle and has two side edges. The coating edge delimiting device includes at least two coating edge delimiting elements fitted between and in direct contact with each of the lips. The coating edge delimiting elements close off and substantially seal the dosing slot on the side edges, thereby substantially sealing the dosing slot. Each coating edge delimiting element has a wall section extending beyond the free ends of the lips in a flow direction of the coating medium through the dosing slot.

12 Claims, 3 Drawing Sheets

APPLICATOR FOR DIRECT OR INDIRECT APPLICATION OF A LIQUID OR PASTY COATING MEDIUM ONTO A TRAVELING MATERIAL WEB

This is a continuation of application Ser. No. 08/905,274 filed Aug. 6, 1997 now U.S. Pat. No. 6,053,978.

BACKGROUND OF THE INVENTION

1. Field of the Invention

The present invention relates to an applicator for direct or indirect application of a liquid or pasty coating medium onto a traveling material web, notably of paper or cardboard.

2. Description of the Related Art

Applicators of the type described above are used in conjunction with so-called coaters to provide one or both sides of a traveling material web consisting, e.g., of paper, cardboard or textile material, with one or several layers of a coating medium, for example, dye, starch, impregnating fluid or the like.

In the so-called direct application, the liquid or pasty coating medium is applied by an applicating apparatus directly onto the surface of the traveling material web, which during application is carried on a revolving backing surface, for example, an endless belt or a backing roll. In the indirect application of the medium, in contrast, the liquid or pasty applicating medium, is first applied onto a substrate surface, e.g., the surface of a backing roll fashioned as an applicator roll, and is transferred there, in a nip through which the material is passed, from the applicator roll to the material web.

Known from U.S. Pat. No. 5,435,847 is an applicator with an applicating apparatus featuring a slot of constant width formed between two opposing walls, through which slot the coating medium being applied is passed onto the material web under pressure. The material web is usually carried by a backing roll associated with the applicating apparatus. This applicator additionally includes a coating edge delimiting apparatus with two coating edge delimiting elements in the form of deckle slides disposed in the slot between the opposing walls and sealing the slot on its side edges. The deckle slides are adapted to the constant width of the slot and have an essentially rectangular cross-sectional shape. Moreover, each of the deckle slides for adjustment of the coating width on the traveling material web is displaceable and fixable in the slot in a direction transverse to the direction of travel of the material web and remains during the operation of the applicator in the position once set. This prior applicator involves disadvantages to the effect that the liquid or pasty coating medium discharging from the slot often issues sideways or splashes out, depending on certain applicating or coating conditions, producing on the coated material web an untidy edge, or edge pattern, thus impairing the quality of the finished product.

Known from U.S. Pat. No. 5,436,030, furthermore, is an applicator for direct or indirect application of a liquid or pasty coating medium onto a traveling material web, notably of paper or cardboard, which applicator includes a dosing apparatus with a dosing slot fashioned as an open-jet nozzle and formed between lips on each of the approach side and the departure side. One embodiment features a deflection surface for the liquid or pasty coating medium, on the free end of the approach side or departure side. The deflection surface borders on the dosing slot and has a concave curvature. Of the two lips forming the dosing slot, the first lip, disposed on the side of the dosing slot that is approached by the applicator roll in the case of indirect application of the medium, or by the material web in the case of direct application, is termed the approach-side lip. Accordingly, the second lip, disposed on the side of the dosing slot from which the applicator roll or the material web departs from the applicator, is called the departure-side lip. In using a concavely curved deflection surface for the liquid or pasty coating medium, which borders on the dosing slot, it has been found that, depending on certain coating conditions or on the liquid or pasty coating medium used, so-called "color sails" can form on the concave deflection surface. A color sail is a thin film developing from coating medium noses that form on the side edge of the dosing slot exit, and can possibly lead to an untidy coating edge.

An applicator comparable with that according to U.S. Pat. No. 5,436,030 is being marketed by the assignee of the present invention under the trade name "Jet Flow F."

SUMMARY OF THE INVENTION

Underlying the present invention, therefore, is the objective of improving a categorial applicator, i.e., an applicator similar to the previously described "Jet Flow F," to the effect that a high quality application with clean coating edges is achieved even under widely varying coating conditions.

The first inventional applicator for direct or indirect application of a liquid or pasty coating medium onto a traveling material web, notably of paper or cardboard, includes at least one dosing apparatus with a dosing slot fashioned as an open-jet nozzle and formed between two lips, of which, viewed in the flow direction of the coating medium, one is longer than the other and forms a guide surface for the coating medium. The applicator also includes a coating edge delimiting apparatus with at least two coating edge delimiting elements that are arranged between the two lips and close the dosing slot off on its side edges, substantially sealing it. Bordering on the end of the coating edge delimiting element associated with the dosing slot exit, viewed in cross section, is a wall section extending along the guide surface of the longer one of the two lips, essentially up to the free end of the longer lip.

Hence, an inventional coating edge delimiting element, the cross-sectional shape of which is preferably adapted to the cross-sectional shape of the dosing slot, protrudes with the wall section through the dosing slot, while the remaining sections of the coating edge delimiting element extend in an edge area situated below the dosing slot exit between the two lips in the dosing slot. The exact shape of the wall section of a coating edge delimiting element is adapted to the guide surface shape of the longer lip, so that the said wall section of the coating edge delimiting element fits flush and without clearance in planar fashion on the guide surface. The top edge of the wall section of a coating edge delimiting element ends on the free top edge of the guide surface of the longer one of the two lips, or somewhat below it. In the applicator according to the invention, the two lips between which the dosing slot is formed may be movable relative to each other, for adjustment of the dosing slot width. Moreover, the guide surface of the longer one of the two lips may be adjustable, for example, through the intermediary of a pivot axle or the like provided in the area of the dosing slot axis, for adjusting the angle of impingement of the coating medium flowing down the guide surface.

The inventional applicator avoids the disadvantages associated with the prior art and enables, even with widely varying coating conditions and widely varying coating medium types, a high-quality application with clean edges and a sharp definition between a coated and uncoated section of the material web, or of the applicator roll. Owing to the coating edge delimiting element of inventional design with a wall section extending from the dosing slot exit up to the top, free end of the guide surface of the longer lip, the liquid or pasty coating medium exiting from the dosing slot is presented, on the side edges of the dosing slot and beyond, an additional lateral guide surface formed by the coating edge delimiting element inside surface facing toward the dosing slot. The coating medium flows along the guide surface until it leaves the dosing apparatus on the top, free end of the guide surface and directly in front of the surface to be coated. A lateral discharge or splashing of the coating medium issuing out of the dosing slot is thus avoided in an easy and effective manner.

In one embodiment of the invention, the top end of the coating edge delimiting element wall section extends, viewed in the flow direction of the coating medium, beyond the free end of the longer lip. Thus, a lateral guide surface is presented to the coating medium even after leaving the guide surface of the longer one of the two lips, which lateral guide surface allows producing a sharp, clean coating edge.

The guide surface of the longer lip can be substantially straight or of a concave or convex shape. Appropriate mixed forms are conceivable as well.

In another embodiment feature of the invention, the wall section of a coating edge delimiting element has in the area of the guide surface a substantially constant wall thickness. This allows the wall section to adapt especially well to the respective shape of the guide surface of the longer lip. With the wall thickness of the coating edge delimiting element matching the dosing slot width, the coating edge delimiting element can, due to this dimensioning, also be easily pulled down and through the dosing slot for removal or replacement. But the invention, naturally, is not limited to this embodiment.

According to yet another embodiment of the inventional applicator, a coating edge delimiting element has a substantially flat inside surface that faces toward a center section of the dosing slot and, as explained above, serves as a lateral guide surface for the liquid or pasty coating medium. Such coating edge delimiting element can be fabricated with particular ease and achieves in most applications the advantages illustrated above.

In still another embodiment, a coating edge delimiting element to has a gutter-like inside surface facing toward a center section of the dosing slot. This allows a further enhancement of the guide effect of the inside surface, and produces good results with more problematic coating mediums.

The opposing coating edge delimiting elements are in the simplest design aligned on one another such that their inside surfaces facing toward the center section of the dosing slot extend substantially parallel to each other. In a further embodiment, the inside surface of a coating edge delimiting element facing toward the center section of the dosing slot has in a front view of the coating edge delimiting element, an arcuate edge pattern such that the inside surfaces of opposing coating edge delimiting elements have a converging arrangement. The liquid or pasty medium flowing along the coating edge delimiting element inside surfaces is thus additionally imparted an impulse directed inward, i.e., toward a center section of the guide surface. The impulse counteracts an unfavorable sideways discharge or splashing of the coating medium. Instead of an arcuate edge pattern, a straight, but oblique edge pattern is possible, which also leads to the converging configuration described above.

In a still further embodiment of the invention, at least one coating edge delimiting element is equipped with a recess for receiving an aperture board that is provided with a plurality of defined through slots. Based on the flow direction of the liquid or pasty coating medium, this recess is provided in the coating edge delimiting element in front of the dosing slot exit. Hence, the coating edge delimiting elements according to the invention can also be employed also in conjunction with an aperture board of the above kind.

The coating edge delimiting elements of the applicator according to the invention can be made of a plastic material. Conventional coating edge delimiting elements, in contrast, are usually are made of a metal such as, for example, bronze.

In another embodiment of the invention, the coating edge delimiting elements are disposed substantially parallel to the longitudinal expanse of the dosing slot, i.e., transverse to the direction of travel of the material web. This allows easy adjustment of the required coating format. The adjustment may be continuous or stepwise. The coating edge delimiting elements are suitably fixable in a chosen aperture board position.

Lastly, in yet another embodiment of the invention, the coating edge delimiting element is arranged substantially parallel to the longitudinal expanse of the dosing slot, allowing a stepwise or oscillating movement. The applicator suitably includes in this context at least one drive connected to the coating edge delimiting elements. The drive advances the coating edge delimiting elements in a stepwise and/or oscillating manner and/or moves them as needed to set the desired coating width. The movement can also be effected manually. Furthermore, the applicator may feature at least one control and/or regulating system communicating with the drive. The movable arrangement of the coating edge delimiting elements allows in an easy and effective manner a considerable reduction and equalization of the local wear at the transitions between the coated and uncoated edge of a doctor element such as typically employed in applicators of the categorial type for leveling the applied medium. Thus, the service life of the doctor elements is increased. As compared to the prior art, this enables longer service intervals before the required replacement of the doctor element, thereby avoiding, in turn, longer cumulative downtime of the applicator and achieving lower overall operating costs. Since no pronounced local point of wear occurs on the doctor element in the inventional applicator, the doctor element is usable with a format adjustment, i.e., a coating width, modified relative to the original setting, without requiring a replacement of the doctor element and without a reduction in quality of the finished product. Also, with the transition points between the coated and uncoated edge being located not on the applicator roll, or backing roll, but on the material web itself, an abrupt thickness difference between a coated and uncoated section of the material web can be effectively avoided. Rather, the applicator according to the invention produces a soft or "blurred" transition between the coated and uncoated section of the material web, which also considerably facilitates the winding, unwinding or rewinding of the material web as well as handling the finished product.

In the second applicator according to the invention, the two lips end approximately at the same level. At least one coating edge delimiting element extends here beyond the free ends of both lips, thereby achieving a still better sealing effect. An illustration of the suitable embodiment of the second invention shall be omitted here, since these options correspond largely to those of the first invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
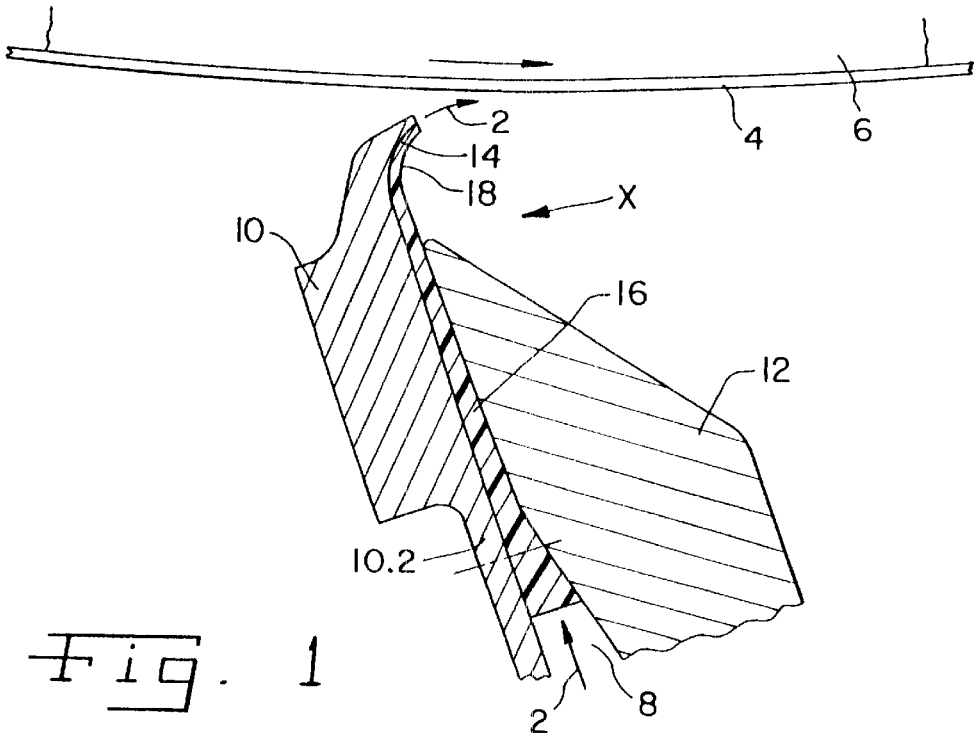
FIG. 1 is a schematic cross-sectional view of one embodiment of the first inventional applicator in the area of the dosing apparatus.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings, and more particularly to FIG. 1, there is shown a schematic cross-sectional view of one embodiment of the inventional applicator for direct or indirect application of a liquid or pasty coating medium 2 onto a traveling material web 4, notably of paper or cardboard, in the area of the applying, or dosing, apparatus. The applicator includes a backing roll 6 carrying material web 4 to be provided with liquid or pasty coating medium 2, web 4 being supported by backing roll 6 in the application process. The direction of travel of material web 4 is prefixed by the direction of rotation of backing roll 6 as indicated in FIG. 1 by an arrow. Extending substantially across the entire machine width and traveling material web 4, the dosing apparatus opposes backing roll 6. Following the dosing apparatus in the direction of travel of material web 4 is a doctor element extending across the entire machine width, for example, a doctor blade or similar. The doctor element scrapes coating medium 2, which is applied at a surplus, down to a suitable profile. The doctor element is not shown in the drawing since it may also be omitted, for example, when applying only as much coating medium as is meant to remain on material web 4. The dosing apparatus includes a dosing slot 8 configured as an open-jet nozzle formed between a lip 10 on the approach side and a lip 12 on the departure side. Viewed in the flow direction of coating medium 2 in dosing slot 8, lip 10 on the approach side is presently longer than lip 12 on the departure side and forms in the area adjacent to the dosing slot exit a guide surface 14 for liquid or pasty coating medium 2. Guide surface 14 has in the present embodiment a concave shape. Lips 10 on the approach side and 12 on the departure side may be movable relative to each other for adjustment of the width of dosing slot 8. Moreover, the concave guide surface 14 is adjustable along with lip 10 on the approach side, for adjusting the angle of impingement of coating medium 2 flowing along guide surface 14. This is realized here by a local thinning 10.2 provided in the area below the dosing slot exit on approach-side lip 10 and forming a pivot axle. The actuators for adjustment of approach-side lip 10 are not illustrated in the drawing, for reason of clarity.

Moreover, the applicator includes a coating edge delimiting apparatus associated with the dosing apparatus and having two coating edge delimiting elements that are made of plastic, called deckle slides 16 hereafter. Deckle slides 16 are disposed between approach-side lip 10 and departure-side lip 12. Deckle slides 16 seal dosing slot 8 on its two side edges, thus prefixing a specific coating width on traveling material web 4. As is evident from FIG. 1, deckle slides 16 have a cross-sectional configuration that is adapted to the cross-sectional shape of dosing slot 8. In the present case, deckle slides 16 have in cross section a conic basic shape which upwardly tapers continuously, that is, toward the exit of dosing slot 8. In principle, of course, deckle slides 16 may also have a different suitable cross-sectional shape, for example, a plain rectangular cross-sectional shape.

Figure 1A:
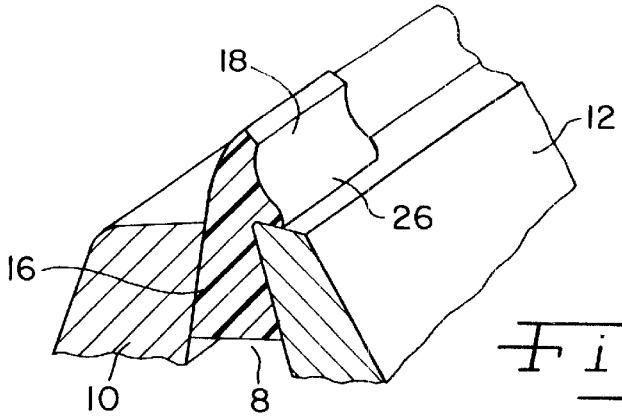
FIG. 1*a* is a schematic perspective view of an embodiment of the second inventional applicator in the area of the dosing apparatus.

From FIG. 1 it also follows that one section of deckle slides 16 coordinated with the exit of dosing slot 8 is followed by a wall section 18 of concave curvature, section 18 extending along concave guide surface 14 of approach-side lip 10 up to its upper free end. Hence, a respective deckle slide 16 protrudes with its wall section 18 of concave curvature through dosing slot 8, whereas the remaining sections of deckle slide 16 extend in an edge area below the dosing slot exit, between approach-side lip and departure-side lip 12 in dosing slot 8. The shape of concave-curvature wall section 18 of deckle slide 16 is adapted to the shape of concave guide surface 14, so that wall section 18 rests on concave guide surface 14 in planar fashion, flush and without clearance. The upper edge of concave-curvature wall section 18, as mentioned above, ends in the present embodiment on the free top edge of concave guide surface 14 of approach-side lip 10. But wall section 18 may also protrude up to shortly below the top edge or beyond, as shown in FIG. 1*a*. The two lips 10 and 12 end in this figure approximately at the same level. According to the illustration in FIG. 1, concave-curvature wall section 18 of deckle slide 16 has in the area of concave guide surface 14 a constant wall thickness matching essentially the width of dosing slot 8. Nonetheless, the invention is not fixed to this dimensioning of wall section 18.

Figure 2:
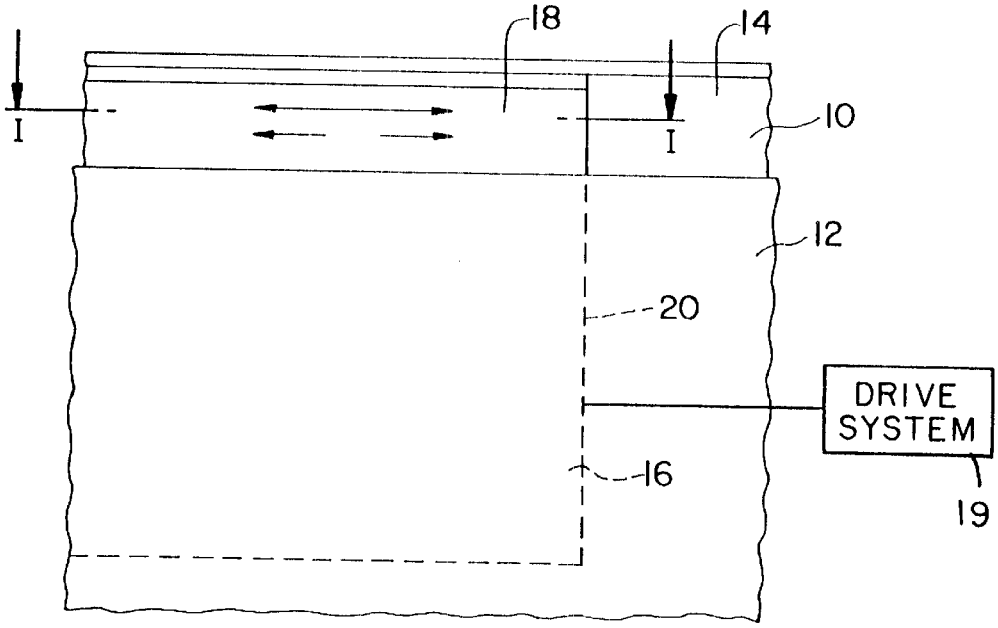
FIG. 2 is a schematic front view of the applicator of FIG. 1 in the area of a coating edge delimiting element, viewed in the direction of arrow X in FIG. 1.

FIG. 2 shows a schematic front view of the applicator relative to FIG. 1 in the area of deckle slide 16, the direction of view corresponding to the direction of arrow X in FIG. 1. As shown in the drawing, opposing deckle slides 16 enclose between them dosing slot 8 in its longitudinal expanse. Deckle slides 16 are aligned with one another such that inside surfaces 20 of deckle slides 16 face toward the center section of dosing slot 8 and extend substantially parallel to each other. The center section of dosing slot 8 is represented in the drawing by a vertical bisecting line. Inside surfaces 20 serve liquid or pasty coating medium 2 issuing out of dosing slot 8 as lateral guide surfaces in the area of the dosing slot side edges. Coating medium 2 flows along the guide surfaces until leaving the dosing apparatus on its upper free end of concave guide surface 14 and directly in front of material web 4 being coated. A sideways discharge or splashing of coating medium 2 issuing out of dosing slot 8 is thus effectively avoided.

Deckle slides 16 are in the present example positioned movably within the lateral edge areas of dosing slot 8. The movable arrangement of deckle slides 16 is such that it allows, for coating width adjustment, easy displacement parallel to the longitudinal expanse of dosing slot 8, i.e., transverse to traveling material web 4. The movable arrangement of deckle slides 16 also allows for coating edge manipulation as well as a stepwise and/or oscillating movement. This mobility of deckle slide 16 is indicated in FIG. 2 by double arrow, the easy displaceability of deckle slide 16 by two separate, opposite arrows of opposite direction.

Each deckle slide 16 is, via suitable linking means, coupled to a drive apparatus 19, schematicallly shown in FIG. 2, and movable by it in the manner described above. The drive system 19 can be incorporated in a closed loop and a control circuit of a control and regulating system allowing an operator to adjust a mean coating width for a given material web width, or for a given width of the backing roll, and to preset, as needed, the exact form of oscillating motion of deckle slides 16. The closed loop, control circuit and control/regulating system are not illustrated in the drawings.

Figure 3:
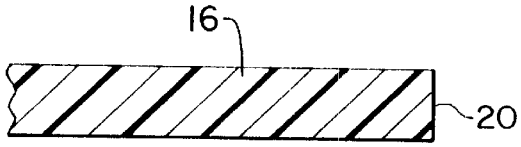
FIG. 3 is a schematic longitudinal cross-sectional view of the coating edge delimiting element, viewed in FIG. 2 along line I—I.

As indicated in FIG. 3 showing a schematic longitudinal section of a deckle slide 16 along line I—I in FIG. 2, inside surface 20 of deckle slide 16 facing toward a center section of dosing slot 8 is in the embodiment according to FIG. 1 and FIG. 2 fashioned as a plain, flat and smooth surface.

Figure 4:
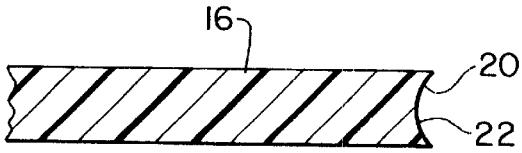
FIG. 4 is a schematic longitudinal cross-sectional view of a second embodiment of a coating edge delimiting element, analogous to the illustration in FIG. 3.

FIG. 4 shows in an illustration analogous to FIG. 3 a schematic longitudinal view of a second embodiment of a deckle slide 16 of the applicator according to the invention. Inside surface 20 of deckle slide 16 has in this variant a gutter-like fillet 22 that enhances the guide effect of inside surface 20.

Figure 5:
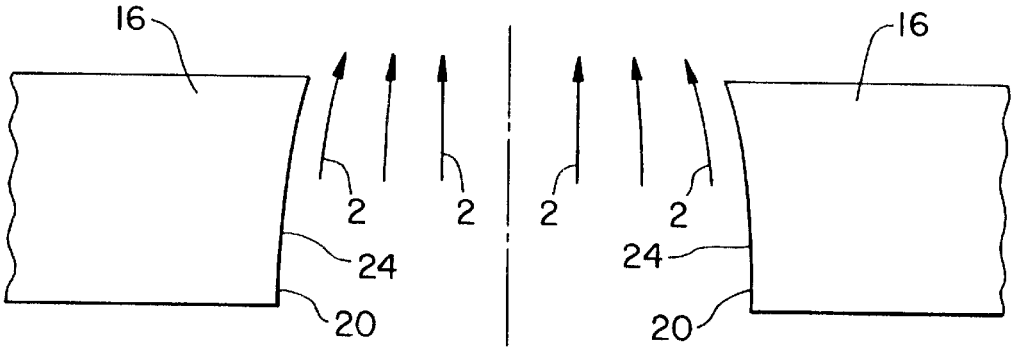
FIG. 5 is a schematic front view of a third embodiment of coating edge delimiting elements, analogous to the illustration in FIG. 2.

FIG. 5 shows a schematic front view of a third embodiment of a deckle slide 16, analogous to the illustration relative to FIG. 2, but with the complete lip on the approach side and departure side omitted for reason of clarity. As follows from the drawing, inside surfaces 20 of deckle slides 16 facing toward the center section of dosing slot 8 have an arcuate edge pattern 24 that results in a convergence of inside surfaces 20 of opposing deckle slides 16. Liquid or pasty coating medium 2 flowing along inside surfaces 20 of deckle slides 16 is thus additionally imparted an impulse directed inward, i.e., toward a center section of concave guide surface 14, the impulse counteracting an unfavorable sideways discharge or splashing of coating medium 2. The center section of concave guide surface 14 is represented in the drawing by a vertical bisecting line. Edge pattern 24, instead of being arcuate, can also be straight and upwardly sloping towards the center, which leads as well to the converging configuration described above.

Figure 6:
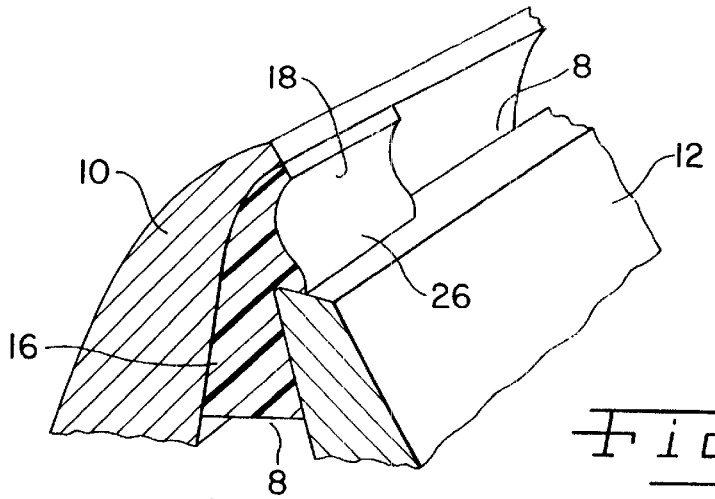
FIG. 6 is a schematic perspective view of a fourth embodiment of a coating edge delimiting element.

FIG. 6 shows a schematic perspective view of a fourth embodiment of the deckle slide where concave-curvature wall section 18, based on its cross-sectional shape, widens in the area of concave guide surface 14 to a step-like shoulder 26 that rests on the top end of departure-side lip 12. Step-like shoulder 26 may serve, e.g., as a guide element for moving deckle slide 16.

Figure 7:
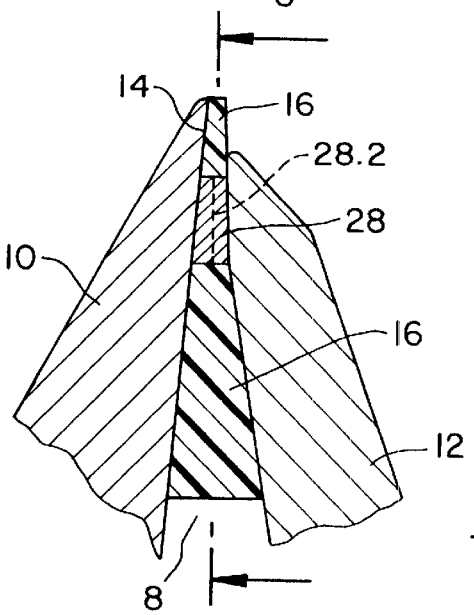
FIG. 7 is a schematic cross-sectional illustration of a fifth embodiment of the inventional applicator, analogous to the illustration in FIG. 1.
Figure 8:
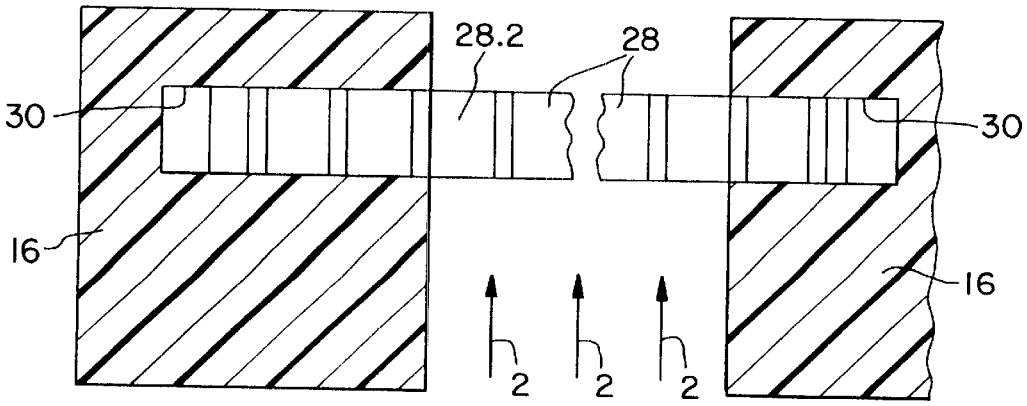
FIG. 8 is a schematic cross-sectional view of FIG. 7 in the area of the dosing slot.

FIG. 7, analogous to the illustration in FIG. 1, shows a schematic cross-sectional view of a fifth embodiment of the inventional applicator. This variant corresponds in its basic structure largely to that pursuant to FIGS. 1, 1*a*, but the longer approach-side lip 10 has a straight guide surface 14, and deckle slides 16 are adapted appropriately in their cross-sectional shape. Deckle slides 16 feature viewed in the flow direction of coating medium 2 in dosing slot 8, in an area in front or beneath the exit of dosing slot 8, a recess 30 to accommodate an aperture board 28 that is provided with a plurality of defined through slots 28.2. Recesses 30 and aperture board 28 are recognizable particularly distinctly in FIG. 8, which shows a schematic sectional view of FIG. 7 in the area of dosing slot 8 and aperture board 28.

The invention is not limited to the above embodiments, which merely serve the general explanation of the basic idea of the invention. Rather, the inventional applicator may in the framework of the scope of protection assume also embodiments other than those described above. Specifically, the applicator may have features that represent a combination of the respective individual features of the claims. Contrary to the above embodiments, departure-side lip 12 may be the longer one, instead of approach-side lip 10. Instead of the plastic material used in the embodiments, the coating edge delimiting elements may generally also be made of other suitable material, for example, bronze, steel and the like. Lastly, not only a coating edge delimiting element, but also the approach-side and/or departure-side lip may comprise guide elements for guiding the coating edge delimiting element during an adjustment motion or during the stepwise and/or oscillating motion.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for direct application of a coating medium onto a traveling fiber material web, said machine comprising:

at least one dosing apparatus including a pair of lips, each of said lips having a free end adjacent the fiber material web, each of said lips having a longitudinal extension extending transverse to a direction of travel of the fiber material web, said lips defining a dosing slot therebetween, said dosing slot being configured as an open-jet nozzle and having two side edges; and a coating edge delimiting apparatus including at least two coating edge delimiting elements fitted between and in direct contact with each of said lips, said coating edge delimiting elements closing off and substantially sealing said dosing slot on said side edges, thereby substantially sealing said dosing slot, each of said coating edge delimiting elements having a wall section extending beyond said free ends of said lips in a flow direction of the coating medium through said dosing slot, said wall section having a concave curvature, said concave curvature facing in a direction of travel of the fiber web material.

2. The applicator of claim 1, wherein said wall section of at least one of said coating edge delimiting elements has a substantially constant wall thickness.

3. The applicator of claim 1, wherein said dosing slot has a center section, at least one of said coating edge delimiting elements having a substantially flat inside surface facing toward said center section.

4. The applicator of claim 1, wherein said dosing slot has a center section, at least one of said coating edge delimiting elements having a concave inside surface facing toward said center section.

5. The applicator of claim 1, wherein said dosing slot has a center section, at least two of said coating edge delimiting elements each having an inside surface facing toward said center section, said inside surfaces extending substantially parallel to each other.

6. The applicator of claim 1, wherein said dosing slot has a center section, at least two of said coating edge delimiting elements each having a inside surface facing toward said center section, said inside surfaces each having an arcuate edge pattern such that the coating medium converges toward said center section.

7. The applicator of claim 1, wherein said coating edge delimiting elements are comprised of plastic.

8. The applicator of claim 7, further comprising a drive apparatus configured for moving said coating edge delimiting elements in at least one of a stepwise and oscillating fashion in a direction substantially parallel to said longitudinal extension of said lips.

9. The applicator of claim 1, further comprising a drive apparatus configured for moving said coating edge delimiting elements in a direction substantially parallel to said longitudinal extension of said lips.

10. An applicator for direct application of a coating medium onto a traveling fiber material web, said machine comprising:

at least one dosing apparatus including a pair of lips, each of said lips having a free end adjacent the fiber material web and extending transverse to a direction of travel of the fiber material web, said lips defining a dosing slot therebetween, said dosing slot being configured as an open-jet nozzle and having two side edges;

a coating edge delimiting apparatus including at least two coating edge delimiting elements fitted between and in direct contact with each of said lips, said coating edge delimiting elements closing off and substantially sealing said dosing slot on said side edges, thereby substantially sealing said dosing slot, each of said coating edge delimiting elements having a wall section extending beyond said free ends of said lips in a flow direction of the coating medium through said dosing slot; and an aperture board having a plurality of through slots, at least one of said coating edge delimiting elements having a recess therein, at least a portion of said aperture board being received by said recess.

11. The applicator of claim 10, wherein said recess in said at least one of said coating edge delimiting elements opens toward said dosing slot.

12. An apparatus for one of direct and indirect application of a coating medium onto a traveling fiber material web, said apparatus comprising:

a traveling substrate, said traveling substrate being one of said traveling fiber material web and a roll, said roll being configured for transferring said coating medium onto said traveling fiber material web; and an applicator for one of direct and indirect application of a coating medium onto said traveling substrate, said applicator further comprising:

at least one dosing apparatus including a pair of lips, each of said lips having a free end adjacent said traveling substrate and extending transverse to a direction of travel of said traveling substrate, said lips defining a dosing slot therebetween, said dosing slot being configured as an open-jet nozzle and having two side edges; and a coating edge delimiting apparatus including at least two coating edge delimiting elements fitted between and in direct contact with each of said lips, said coating edge delimiting elements closing off and substantially sealing said dosing slot on said side edges, thereby substantially sealing said dosing slot, each of said coating edge delimiting elements having a wall section extending beyond said free ends of said lips in a flow direction of the coating medium through said dosing slot, said wall section having a concave curvature, said concave curvature facing in a direction of travel of the traveling substrate.

* * * * *